US008210017B2

(12) United States Patent
Suzuki et al.

(10) Patent No.: US 8,210,017 B2
(45) Date of Patent: Jul. 3, 2012

(54) STEEL PIPE DRAWING APPARATUS AND DRAWN STEEL PIPE MANUFACTURING METHOD

(75) Inventors: Akira Suzuki, Yokohama (JP); Toshio Inoue, Yokohama (JP)

(73) Assignee: Sanwa Kokan Co., Ltd, Yokohama (JP)

( * ) Notice: Subject to any disclaimer, the term of this patent is extended or adjusted under 35 U.S.C. 154(b) by 206 days.

(21) Appl. No.: 12/657,042

(22) Filed: Jan. 13, 2010

(65) Prior Publication Data

US 2011/0048089 A1 Mar. 3, 2011

(30) Foreign Application Priority Data

Aug. 28, 2009 (JP) ..... 2009-198845

(51) Int. Cl.
*B21C 1/24* (2006.01)

(52) U.S. Cl. ..... 72/283; 72/276; 72/291

(58) Field of Classification Search ..... 72/276, 72/283, 285, 291, 370.25
See application file for complete search history.

(56) References Cited

U.S. PATENT DOCUMENTS 5,119,662 A * 6/1992 Sunaga et al. ..... 72/283
7,114,362 B2 * 10/2006 Mitchell et al. ..... 72/370.25

FOREIGN PATENT DOCUMENTS

JP 59-073113 5/1984
JP 59-073115 5/1984

* cited by examiner

*Primary Examiner* — David Jones
(74) *Attorney, Agent, or Firm* — Fattibene and Fattibene, LLC; Paul A. Fattibene

(57) ABSTRACT

A steel pipe drawing apparatus, which can manufacture a drawn steel pipe which is a long object with high accuracy and at high speed as well as improves dimensional accuracy of respective thick-wall portions and cutting positions of the drawn steel pipe, is realized. When a stepped drawn steel pipe is manufactured by moving a die and a plug relatively in the same direction as a steel pipe drawing direction and in an opposite direction thereto, a first hydraulic cylinder moves the die relatively in a direction corresponding to the steel pipe drawing direction, and a second hydraulic cylinder moves the plug relatively in a direction opposite to a moving direction of the die. At this time, a position detecting sensor detects a stroke position of the second hydraulic cylinder, and a computer receives positional information detected by the position detecting sensor and controls a moving velocity of the second hydraulic cylinder. Thereby, the computer makes a moving velocity v2 of the second hydraulic cylinder higher than a moving velocity v1 thereof in "b" region based upon a position detecting signal in "d" region. Therefore, the drawn steel pipe is drawn at the higher moving velocity v2 so that no sag occurs in a wall-thickness gradient in the "d" region.

6 Claims, 6 Drawing Sheets

STEEL PIPE DRAWING APPARATUS AND DRAWN STEEL PIPE MANUFACTURING METHOD

BACKGROUND OF THE INVENTION

1. Field of the Invention

The present invention relates to a steel pipe drawing apparatus and a drawn pipe manufacturing method, and in particular to a steel pipe drawing apparatus and a drawn steel pipe manufacturing method for manufacturing a drawn steel pipe by moving a die and a plug relatively in the same direction as a steel pipe drawing direction and in an opposite direction thereto.

2. Description of the Prior Art

Conventionally, a hollow shaft with a desired wall-thickness has been preferably used for a boring rod for resource development, a shaft of an automobile or the like in view of reduction in weight and reduction in materials cost. The hollow shaft served for these applications is formed from a stepped drawn steel pipe with a plurality of outer diameters and a plurality of inner diameters formed along a longitudinal direction. Such a drawn steel pipe is manufactured by cold-drawing a material steel pipe using a die and a plug generally (for example, see Patent Literature 1 and Patent Literature 2). According to such a drawn steel pipe manufacturing method, by drawing a material steel pipe while pressing it between the die and the plug using a steel pipe drawing apparatus, a drawn steel pipe with a desired size is manufactured. At this time, by changing a bearing diameter of the die and a bearing diameter of a tap properly according to a drawing position of the material steel pipe, a stepped drawn steel pipe with a plurality of outer diameters and a plurality of inner diameters formed along the longitudinal direction can be manufactured.

Patent Literature 1: Japanese Patent Application Laid-Open Publication No. 59-73113

Patent Literature 2: Japanese Patent Application Laid-Open Publication No. 59-73115

In the above conventional steel pipe drawing apparatus, however, a moving velocity of a hydraulic cylinder is constant regardless of a cold-drawing velocity. In other words, in the conventional steel pipe drawing apparatus, because the drawing velocity is constant regardless of change of a wall-thickness of the drawn steel pipe, dimension accuracy of a portion whose wall-thickness changes in a stepped drawn steel pipe is lowered. Specifically, when the material steel pipe is drawn, sags occur in a wall-thickness gradient in a second wall-thickness changing region in which the material steel pipe is drawn such that the wall-thickness becomes thicker in comparison to a wall-thickness gradient of a first wall-thickness changing region in which the material steel pipe is drawn such that the wall-thickness becomes thinner, which results in that dimensional accuracy of the second wall-thickness changing region is extremely lowered in comparison to that of the first wall-thickness changing region. As a result, there occurs such a defect that cutting positions of a continuous drawn steel pipe which is a long object cannot be managed with high accuracy.

Further, since the conventional steel pipe drawing apparatus is not computer-controlled, a dimensional tolerance of a drawn steel pipe cannot be improved, which results in lowering of a grade average of drawn steel pipe products. Furthermore, since the number of moving strokes of the hydraulic cylinder is set to a few times (four, for example), the whole length of a continuous drawn steel pipe manufactured by the steel pipe drawing apparatus is restricted. In other words, one stroke is a stroke for forming a drawn steel pipe corresponding to one piece produced by moving the hydraulic cylinder once back and forth, and a serial drawn steel pipe with a size corresponding to four pieces is manufactured by four strokes, but in the case of a drawn steel pipe which is a long object with a size corresponding to about four pieces, there occurs such a defect as increase in dimensional tolerance in the longitudinal direction. Therefore, in the conventional steel pipe drawing apparatus, in view of maintaining dimensional accuracy in the longitudinal direction of the drawn steel pipe with high accuracy, the number of the moving strokes of the hydraulic cylinder cannot be increased more than about four times. In other words, in the conventional steel pipe drawing apparatus, a drawn steel pipe which is a long object cannot be manufactured with high accuracy.

Therefore, there occurs technical problems which must be solved in order to achieve a steel pipe drawing apparatus and a drawn steel pipe manufacturing method which can manufacture a drawn steel pipe which is a long object with high accuracy and at high speed as well as improve dimensional accuracy of respective wall-thicknesses portions and cutting positions of a drawn steel pipe, and an object of the present invention is to solve the problems.

SUMMARY OF THE INVENTION

The present invention has been proposed in order to attain the above object. According to a first aspect of the present invention, there is provided a steel pipe drawing apparatus for manufacturing a stepped drawn steel pipe by moving a die and a plug relatively in the same direction as a steel pipe drawing direction and in the opposite direction thereto, comprising at least: a first hydraulic cylinder which moves the die relatively in a direction corresponding to the steel pipe drawing direction; a second hydraulic cylinder which moves the plug relatively in an opposite direction to the moving direction of the die; a position detecting sensor which detects a stroke position of the second hydraulic cylinder; and a computer which receives positional information detected by the position detecting sensor and controls a moving velocity of the second hydraulic cylinder based upon the positional information.

According to this configuration, the steel pipe drawing apparatus comprises the position detecting sensor which detects a stroke position of the second hydraulic cylinder which performs moving control of the plug. Then, the computer receives positional information of the second hydraulic cylinder detected by the position detecting sensor and controls a moving velocity of the second hydraulic cylinder based upon the positional information. Since the computer makes the moving velocity of the second hydraulic cylinder and a drawing velocity of a material steel pipe correspond to each other at this time, the drawing velocity of the material steel pipe can be controlled according to the stroke position of the second hydraulic cylinder. Thereby, a drawn steel pipe can be manufactured at the drawing velocity corresponding to the position of the material steel pipe, therefore dimensional accuracy of respective portions of the drawn steel pipe is improved, as well as cutting portions of the drawn steel pipe can be positioned with high accuracy, therefore it becomes possible to improve productivity of a drawn steel pipe.

According to a second aspect of the present invention, there is provided the steel pipe drawing apparatus according to the first aspect, wherein when the drawn steel pipe corresponding to one piece is produced in one reciprocating stroke of the second hydraulic cylinder, the computer controls the moving velocity of the second hydraulic cylinder to equalize to each other an inclination angle of a wall-thickness gradient of the drawn steel pipe at a time of moving a bearing of the plug from a small diameter to a large diameter in a forward stroke and an inclination angle of the wall-thickness gradient of the drawn steel pipe at a time of moving the bearing of the plug from the large diameter to the small diameter in a backward stroke.

According to this configuration, a drawn steel pipe corresponding to one piece is produced when the second hydraulic cylinder performs one stroke, and a drawn steel pipe which is a long object comprising a plurality of continuous pieces is manufactured by repeating the stroke of the second hydraulic cylinder plural times. At this time, a wall-thickness gradient (a first wall-thickness gradient) in a direction in which a bearing of the plug moves from a small diameter to a large diameter to make a wall-thickness thin occurs in a forward stroke of the second hydraulic cylinder, and a wall-thickness gradient (a second wall-thickness gradient) in a direction in which the bearing of the plug moves from the large diameter to the small diameter to make the wall-thickness thick occurs in a backward stroke of the second hydraulic cylinder. On the other hand, the computer controls the moving velocity at respective stroke positions of the second hydraulic cylinder. Therefore, an inclination angle of the first wall-thickness gradient and an inclination angle of the second wall-thickness gradient can be equalized to each other by controlling the moving velocity according to the stroke position, so that no sag occurs in the second wall-thickness gradient. As a result, dimensions of respective portions of the drawn steel pipe can be managed with high accuracy, as well as the cutting positions of the drawn steel pipe can be positioned with high accuracy.

According to a third aspect of the present invention, there is provided the steel pipe drawing apparatus according to the second aspect, wherein the computer performs velocity control to make a second moving velocity v2 of the second hydraulic cylinder at the time of moving the bearing of the plug from the large diameter to the small diameter higher than a first moving velocity v1 of the second hydraulic cylinder at the time of moving the bearing of the plug from the small diameter to the large diameter.

According to this configuration, the second moving velocity v2 at a time of forming the second wall-thickness gradient in which the bearing of the plug moves the large diameter to the small diameter in the backward stroke of the second hydraulic cylinder to make the wall-thickness thick is made higher than the first moving velocity v1 at a time of forming the first wall-thickness gradient in which the bearing of the plug moves from the small diameter to the large diameter in the forward stroke of the second hydraulic cylinder to make the wall-thickness thin. Thereby, no sag occurs in the gradient in the region of the second wall-thickness gradient, so that the first wall-thickness gradient and the second wall-thickness gradient can be made to have the same inclination angle. As a result, dimensions of respective portions of the drawn steel pipe can be managed with high accuracy, as well as the cutting positions of the drawn steel pipe can be positioned with high accuracy.

According to a fourth aspect of the present invention, there is provided a drawn steel pipe manufacturing method for manufacturing a stepped drawn steel pipe by moving a die and a plug relatively in the same direction as a steel pipe drawing direction and in an opposite direction thereto, comprising: a first step, at which the die is moved relatively in a direction corresponding to the steel pipe drawing direction by a first hydraulic cylinder while the plug is moved relatively in a direction opposite to a moving direction of the die by a second hydraulic cylinder; a second step, at which a position detecting sensor detects a stroke position of the second hydraulic cylinder; and a third step, at which a computer receives positional information detected by the position detecting sensor and controls a moving velocity of the second hydraulic cylinder based upon the positional information.

According to this method, the position detecting sensor which detects a stroke position of a second hydraulic cylinder which performs moving control of a plug is provided, and the computer receives positional information of the second hydraulic cylinder detected by the position detecting sensor and controls a moving velocity of the second hydraulic cylinder based upon the positional information. Since the computer makes the moving velocity of the second hydraulic cylinder and a drawing velocity of a material steel pipe correspond to each other at this time, as a result, the drawing velocity of the material steel pipe can be controlled according to the stroke position of the second hydraulic cylinder. Thereby, a drawn steel pipe can be manufactured at the drawing velocity according to the position of the material steel pipe, therefore dimensional accuracy of respective portions of the drawn steel pipe is improved, as well as cutting portions of the drawn steel pipe can be positioned with high accuracy, therefore it becomes possible to improve productivity of the drawn steel pipe.

According to a fifth aspect of the present invention, there is the drawn steel pipe manufacturing method according to the fourth aspect, wherein: the second hydraulic cylinder produces one piece of the drawn steel pipe in one reciprocating stroke at the first step; and the computer controls the moving velocity of the second hydraulic cylinder at the third step to equalize to each other an inclination angle of a wall-thickness gradient of the drawn steel pipe at a time of moving a bearing of the plug from a small diameter to a large diameter in a forward stroke and an inclination angle of a wall-thickness gradient of the drawn steel pipe at a time of moving the bearing of the plug from the large diameter to the small diameter in a backward stroke.

According to this method, a drawn steel pipe corresponding to one piece is produced when the second hydraulic cylinder performs one stroke, and a drawn steel pipe which is a long object comprising a plurality of continuous pieces is manufactured by repeating the stroke of the second hydraulic cylinder plural times. At this time, a wall-thickness gradient (a first wall-thickness gradient) in a direction in which a bearing of the plug moves from a small diameter to a large diameter in a forward stroke of the second hydraulic cylinder to make a wall-thickness thin occurs, and a wall-thickness gradient (a second wall-thickness gradient) in a direction in which the bearing of the plug moves from the large diameter to the small diameter in a backward stroke thereof to make the wall-thickness thick occurs. On the other hand, the computer controls the moving velocity at respective stroke positions of the second hydraulic cylinder. Therefore, an inclination angle of the first wall-thickness gradient and an inclination angle of the second wall-thickness gradient can be equalized to each other by controlling the moving velocity according to the stroke position, so that no sag occurs in the second wall-thickness gradient. As a result, dimensions of respective portions of the drawn steel pipe can be managed with high accuracy, as well as the cutting positions of the drawn steel pipe can be positioned with high accuracy.

According to a sixth aspect of the present invention, there is provided the drawn steel pipe manufacturing method according to the fifth aspect, wherein the computer performs velocity control at the third step to make a second moving velocity of the second hydraulic cylinder at the time of moving the bearing of the plug from the large diameter to the small diameter higher than a first moving velocity of the second hydraulic cylinder at the time of moving the bearing of the plug from the small diameter to the large diameter.

According to this method, a second moving velocity v2 of the second wall-thickness gradient in which the bearing of the plug moves the large diameter to the small diameter in the backward stroke of the second hydraulic cylinder to make the wall-thickness thick is made higher than a first moving velocity v1 of the first wall-thickness gradient in which the baring of the plug moves from the small diameter to the large diameter in the forward stroke thereof to make the wall-thickness thin. Thereby, no sag occurs in the gradient in the region of the second wall-thickness gradient, so that the first wall-thickness gradient and the second wall-thickness gradient can be inclinations at the same angle. As a result, dimensions of respective portions of the drawn steel pipe can be managed with high accuracy, therefore the cutting positions of the drawn steel pipe can be positioned with high accuracy.

EFFECT OF THE INVENTION

In the invention of the first aspect, since the position detecting sensor which detects the stroke position of the second hydraulic cylinder which moves the plug is provided, and the computer controls the velocity of the second hydraulic cylinder based upon the positional information detected by the position detecting sensor, dimensional accuracy of respective portions of a drawn steel pipe can be improved. Further, since the cutting positions of the drawn steel pipe can be positioned with high accuracy, productivity of the drawn steel pipe can be improved.

In the invention of the second aspect, since the inclination angle of the wall-thickness gradient (the first wall-thickness gradient) in the direction in which the wall-thickness becomes thinner and the inclination angle of the wall-thickness gradient (the second wall-thickness gradient) in the direction in which the wall-thickness becomes thinner are equalized to each other by the velocity control on the second hydraulic cylinder, the cutting positions of the drawn steel pipe can be positioned with further high accuracy in addition to the effect of the invention of the first aspect.

In the invention of the third aspect, since the moving velocity v2 at the time of forming the second wall-thickness gradient in which the wall-thickness becomes thicker in the backward stroke is made higher than the moving velocity v1 at the time of forming the first wall-thickness gradient in which the wall-thickness becomes thinner in the forward stroke, the inclination angles of the first wall-thickness gradient and the second wall-thickness gradient are equalized to each other, therefore the cutting positions of the drawn steel pipe can be positioned more accurately in addition to the effect of the invention of the second aspect.

In the invention of the fourth aspect, since the position detecting sensor which detects the stroke position of the second hydraulic cylinder which moves the plug is provided, and the computer controls the velocity of the second hydraulic cylinder based upon the positional information detected by the position detecting sensor, dimensional accuracy of respective portions of a drawn steel pipe can be improved. Further, since the cutting positions of the drawn steel pipe can be positioned with high accuracy, productivity of the drawn steel pipe can be improved.

In the invention of the fifth aspect, since the inclination angle of the wall-thickness gradient (the first wall-thickness gradient) in the direction in which the wall-thickness becomes thinner and the inclination angle of the wall-thickness gradient (the first wall-thickness gradient) in the direction in which the wall-thickness becomes thinner are equalized to each other, the cutting positions of the drawn steel pipe can be positioned with further high accuracy in addition to the effect of the invention of the fourth aspect.

In the invention of the sixth aspect, since the moving velocity v2 at the time of forming the second wall-thickness gradient in which the wall-thickness becomes thicker in the backward stroke is made higher than the moving velocity v1 at the time of forming the first wall-thickness gradient in which the wall-thickness becomes thinner in the forward stroke, the inclination angles of the first wall-thickness gradient and the second wall-thickness gradient are equalized to each other, therefore the cutting positions of the drawn steel pipe can be positioned more accurately in addition to the effect of the invention of the fifth aspect.

BEST MODE FOR CARRYING OUT THE INVENTION

Figure 1:
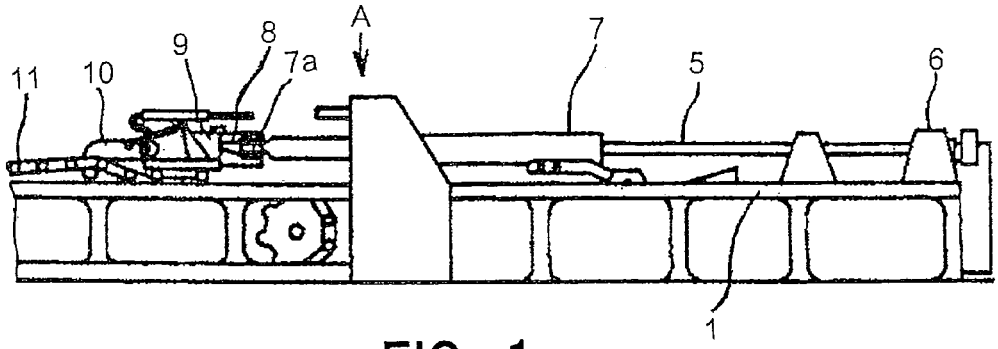
FIG. 1 is a side view of a general steel pipe drawing apparatus.

In order to attain the object of realizing a steel pipe drawing apparatus and a drawn steel pipe manufacturing method, which can manufacture a drawn steel pipe which is a long object with high accuracy and at high speed, as well as improve dimensional accuracy of respective wall-thickness portions and cutting positions of a drawn steel pipe, the present invention is realized by a steel pipe drawing apparatus for manufacturing a stepped drawn steel pipe by moving a die and a plug relatively in the same direction as a steel pipe drawing direction and an opposite direction thereto, comprising at least: a first hydraulic cylinder which moves the die relatively in a direction corresponding to the steel pipe drawing direction; a second hydraulic cylinder which moves the plug relatively in a direction opposite to a moving direction of the die; a position detecting sensor which detects a stroke position of the second hydraulic cylinder; and a computer which receives positional information detected by the position detecting sensor and controls a moving velocity of the second hydraulic cylinder based upon the positional information.

That is, in the steel pipe drawing apparatus according to the present invention, the position detecting sensor is provided on a hydraulic cylinder (a second hydraulic cylinder) which moves a plug, so that a feedback loop for controlling a moving velocity of a stroke of the second hydraulic cylinder based upon a position detecting signal sent by the position detecting sensor is configured. Thereby, the steel pipe drawing apparatus can manufacture a drawn steel pipe while controlling the moving velocity of the second hydraulic cylinder according to a position at a time of drawing a material steel pipe. At this time, by making a drawing velocity of the material steel pipe and the moving velocity of the second hydraulic cylinder interchangeable, dimensional accuracy of respective portions of the drawn steel pipe can be dramatically improved even if a drawn steel pipe to be manufactured has a complicatedly-stepped wall-thickness in a longitudinal direction. Further, at a cutting step of a drawn steel pipe, which is a posterior step, based upon the positional information captured by the position detecting sensor, a drawn steel pipe which is a long object comprising a plurality of continuous pieces can be cut piece by piece, therefore it becomes unnecessary to perform such a determination of a cutting position using an ultrasonic wall-thickness meter as conventionally performed, so that speed-up of cutting work of a drawn steel pipe and work rationalization can be achieved.

Furthermore, since these works (namely, the velocity control on the second hydraulic cylinder and the cutting work of the drawn steel pipe based upon a feedback of the position detecting information captured by the position detecting sensor) are automatically controlled by the computer, dimensional tolerances of respective portions can be dramatically improved. Besides, since the number of moving strokes of the second hydraulic cylinder is not restricted to a few strokes (four strokes, for example) unlike a conventional art, a continuous drawn steel pipe which is a long object can be manufactured with high dimensional accuracy with no restriction of a length of the drawn steel pipe. That is, theoretically an infinite-long continuous drawn steel pipe can be manufactured with high dimensional accuracy by continuous strokes of the second hydraulic cylinder. Incidentally, in practice, in view of size restriction of a steel pipe drawing apparatus, the maximum continuous length of a drawn steel pipe comprising multiple pieces is about 10 meters.

Hereinafter, a preferred embodiment of the present invention will be explained in detail with reference to FIGS. 1 to 8. Incidentally, in respective drawings used for the embodiment explained below, same components are denoted by same reference numerals, and repetition in explanation will be omitted.

Embodiments

Figure 2:
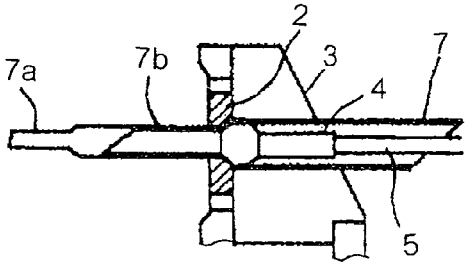
FIG. 2 is a vertical sectional view showing the detail of a portion indicated by "A" in FIG. 1.

First, a general configuration of a steel pipe drawing apparatus for manufacturing a hollow drawn steel pipe will be explained. FIG. 1 is a side view of a general steel pipe drawing apparatus, and FIG. 2 is a vertical sectional view showing the detail of a portion indicated by "A" in FIG. 1. As shown in FIGS. 1 and 2, a die supporting stand 3 for fixing a die 2 is provided at an approximately-central portion of a frame 1 fixed on a floor. Further, a plug 4 and a plug supporting rod 5 for supporting the plug 4 are provided, and the plug supporting rod 5 is fixed on a plug supporting stand 6 via a hydraulic cylinder (not shown) or the like. A material steel pipe 7 is fitted on outer diameter sides of the plug 4 and the plug supporting rod 5, and a distal end portion 7*a* of the material steel pipe 7 is held in a nipping manner by a nipper 8 provided in a drawing car 9. Further, by pulling a tab 10 of the drawing car 9 forcefully by a chain 11 driven by a powerful driving source (not shown), the material steel pipe 7 is drawn while being pressed between the die 2 and the plug 4, thereby a drawn steel pipe 7*b* is manufactured.

In the steel pipe drawing apparatus of the present invention, in a case in which a stepped drawn steel pipe 7*b* with a plurality of inner diameters and outer diameters is manufactured, such a configuration is adopted that the die 2 having a plurality of bearing faces and the plug 4 having a plurality of bearing faces are used in combination, and the die 2 and the plug 4 can be moved relatively in the same direction as a drawing direction and in an opposite direction thereto. Thereby, even if the drawn steel pipe 7*b* is a pipe with a small inner diameter, no wrinkle is generated therein, and a strong drawn steel pipe with high dimensional accuracy can be manufactured.

Figure 3:
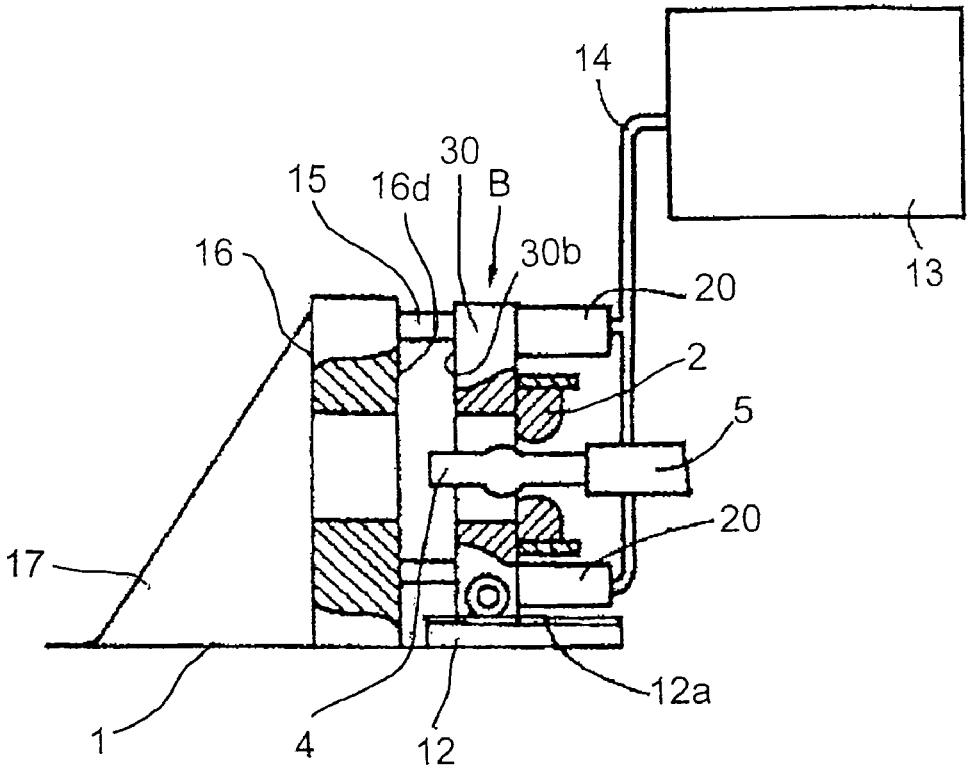
FIG. 3 is a side view of a die supporting stand applied to a steel pipe drawing apparatus of the present invention.
Figure 4:
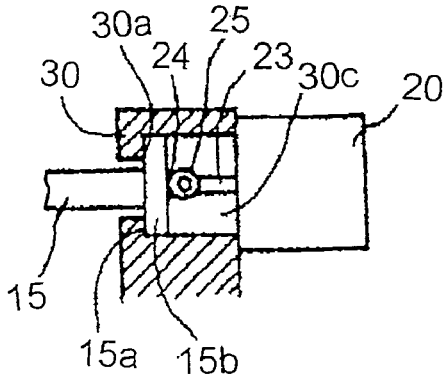
FIG. 4 is a vertical sectional view showing the detail of a portion indicated by "B" in FIG. 3.

In order to realize such a steel pipe drawing apparatus, how to hold the die 2 and the plug 4 relatively is different from the conventional art, configurations of these portions will be first explained. FIG. 3 is a side view of a die supporting stand applied to the steel pipe drawing apparatus of the present invention, and FIG. 4 is a vertical sectional view showing the detail of a portion indicated by "B" in FIG. 3.

As shown in FIG. 3, a stopper 16 is rigidly fixed on the frame 1, and reinforced by a reinforcing member 17. On the other hand, a die supporting stand 30 attached with first hydraulic cylinders 20 for driving the die 2 is movably mounted on a carriage 12, and the carriage 12 moves on a rail 12*a*. Further, one end of a die supporting stand fixing ram 15 is fixed on the stopper 16. Specifically, as shown in FIG. 4, a face 15*a* of a large-diametrical flange portion 15*b* at the other end of the die supporting stand fixing ram 15 is pressed onto a bottom 30*a* of a cylindrical recessed portion 30*c* in the die supporting stand 30 by pressure of the first hydraulic cylinder 20 via a lug 24 which projects from the die supporting stand fixing ram 15 and is coupled to a piston rod 23 by a pin 25.

At this time, pressing force (thrusting force) generated in the first hydraulic cylinder 20 is a force resisting a pipe drawing force, and the pressing force of the first hydraulic cylinder 20 must be stronger than the pipe drawing force (150 to 200 t, for example). In order to perform fixation at a point existing in space by such a large force, a fixing method utilizing pressing onto the stopper 16 is the simplest method.

Further, the die 2 is mounted on the die supporting stand 30. Therefore, fixing positions of the die 2 are a fixing position on the right side of the die supporting stand 30 and a position where a face 30*b* of the die supporting stand 30 abuts on a face 16*d* of the stopper 16, which corresponds to a fixing position on the left side thereof.

Figure 5:
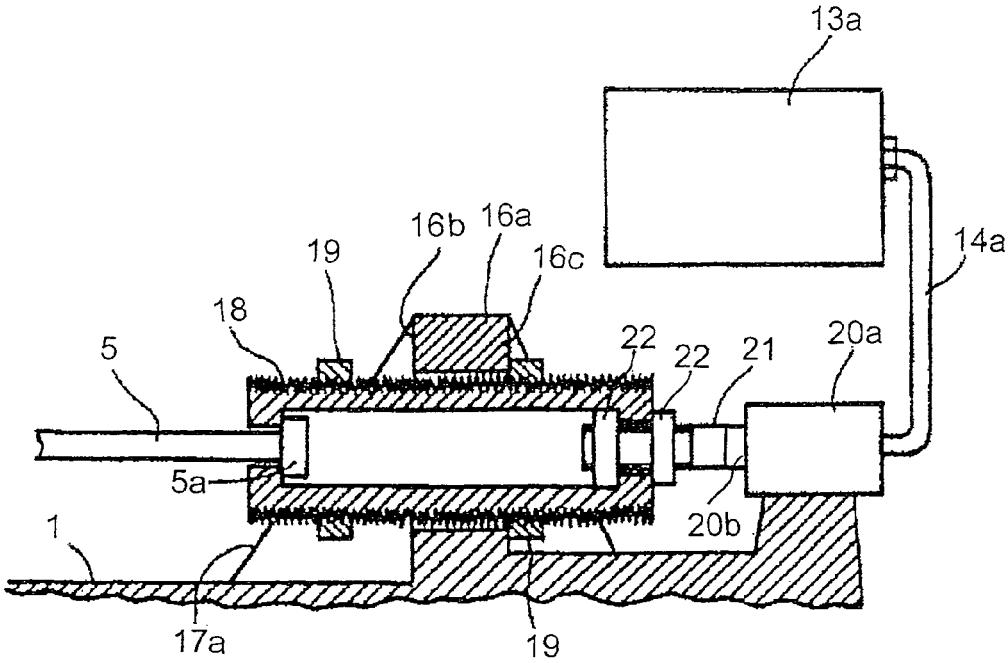
FIG. 5 is a cross-sectional view of a plug supporting stand applied to the steel pipe drawing apparatus of the present invention.

FIG. 5 is a cross-sectional view of a plug supporting stand applied to the steel pipe drawing apparatus of the present invention. As shown in FIG. 5, a stopper 16*a* is rigidly fixed on the frame 1, and further the stopper 16*a* is reinforced by a reinforcing member 17*a*. Furthermore, the plug supporting rod 5 is fitted in a hollow adjust screw shaft 18, and threading nut-type stoppers 19 are screwed on to the outer periphery of the hollow adjust screw shaft 18 supporting a flange portion 5*a* at an end portion of the plug supporting rod 5 in an engaging manner. The nut-type stoppers 19 can be adjusted in a screwing manner in order to adapt to a required dimension of a drawn steel pipe.

A position at which the nut-type stopper 19 on the left side abuts on a face 16*b* of the stopper 16*a* is a right-side fixing position, while a position at which the nut-type stopper 19 on the right side abuts on a face 16*c* of the stopper 16*a* is a left-side fixing position. Further, a pressing or pulling pressure of a second hydraulic cylinder 20*a* for plug driving fixed on the frame 1 is, of course, a generated pressure larger than the pipe drawing pressure. Further, a ram 21 is fitted in an end of the hollow adjust screw shaft 18, and fixed on the hollow adjust screw shaft 18 by screwing a ram fixing nut 22 on a male screw at the distal end of the ram 21.

Incidentally, regarding fixation of the die 2 or the plug 4 or movement thereof during pipe drawing, as shown in FIG. 3, hydraulic pressure from a first hydraulic unit 13 is supplied to the first hydraulic cylinder 20 through a pipe 14 so that the die 2 is driven by the first hydraulic cylinder 20. Also, as shown in FIG. 5, hydraulic pressure from a second hydraulic unit 13*a* is supplied to the second hydraulic cylinder 20*a* through a pipe 14*a* so that the plug 4 is driven by the second hydraulic cylinder 20*a*. That is, the first hydraulic cylinder 20 in FIG. 3 is a hydraulic cylinder for die driving, while the second hydraulic cylinder 20*a* in FIG. 5 is a hydraulic cylinder for plug driving. Incidentally, since the plug 4 is attached at the distal end of the plug supporting rod 5, it is not shown in FIG. 5.

Here, a feature point of the present invention lies in that, as shown in FIG. 5, a position detecting sensor 20*b* is attached to the second hydraulic cylinder 20*a* for plug driving in an additional manner. Specifically, the position detecting sensor 20*b* can be provided between the second hydraulic cylinder 20*a* and the ram 21 in an additional manner. Then the position detecting sensor 20*b* configures a control-system feedback loop, which is configured to detect a stroke position of the second hydraulic cylinder 20*a*, feed back a position detecting signal to the computer, and control a moving velocity according to the stroke position of the second hydraulic cylinder 20*a*.

At this time, since a drawing velocity of a drawn steel pipe and a moving velocity of the second hydraulic cylinder 20*a* are interchangeable (namely, one-to-one correspondence relationship), as a result, the drawing velocity of the drawn steel pipe is controlled according to the stroke position of the second hydraulic cylinder 20*a*. Incidentally, the position detecting sensor 20*b* can be easily realized by, for example, an encoder.

Figure 6A:
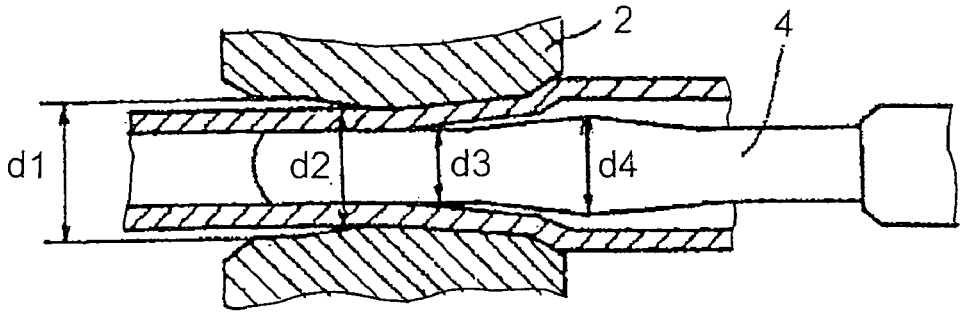
FIGS. 6A, 6B and 6C are vertical sectional views showing drawing states caused by a die and a plug applied to the steel pipe drawing apparatus of the present invention.
Figure 6B:
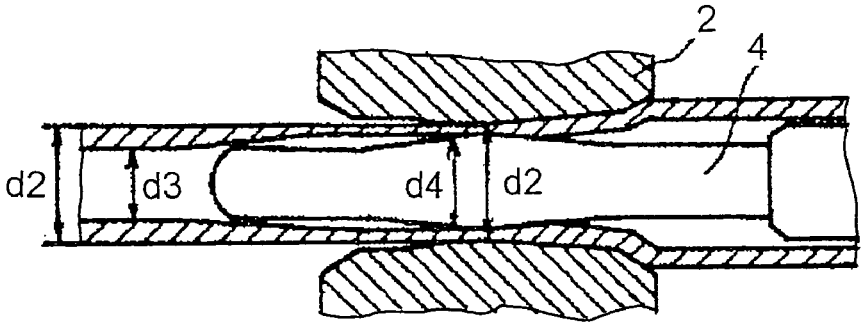
Figure 6C:
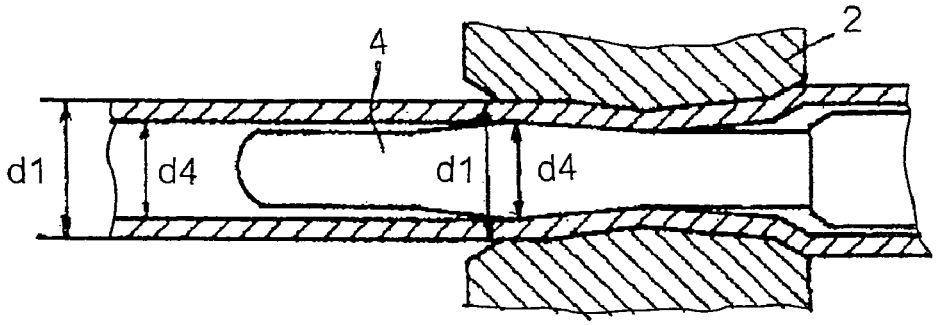
Figure 7A:
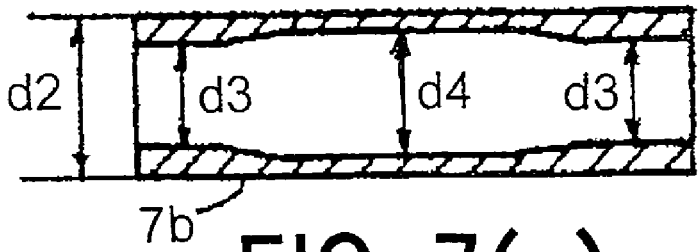
FIGS. 7A, 7B and 7C are vertical sectional views illustrating drawn pipes manufactured by the steel pipe drawing apparatus of the present invention.
Figure 7B:
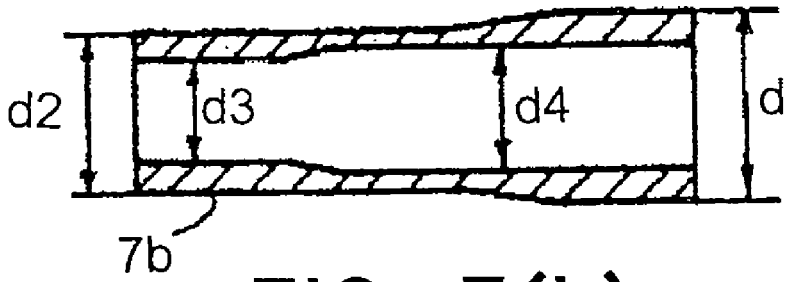
Figure 7C:
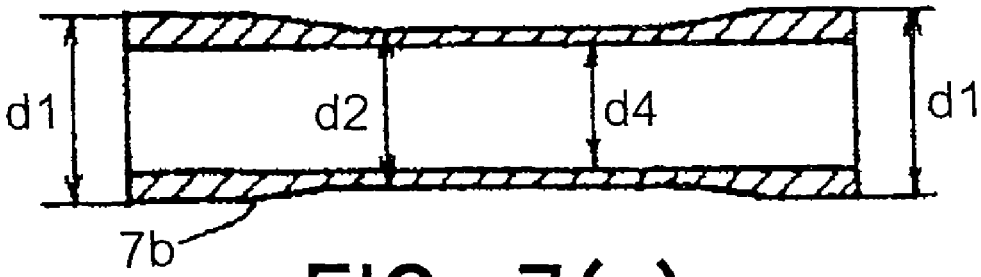

FIGS. 6A, 6B and 6C are vertical sectional views showing drawing states caused by the die and the plug applied to the steel pipe drawing apparatus of the present invention, and FIGS. 7A, 7B and 7C are vertical sectional views illustrating drawn steel pipes manufactured by the steel pipe drawing apparatus of the present invention. As shown in FIGS. 6A, 6B and 6C, the plug 4 and the die 2 according to the present invention have diameters formed in a stepped manner, respectively. The plug 4 has a large-diametrical bearing diameter d4 on the side of a proximal end thereof, following a small-diametrical bearing diameter d3 at a distal end thereof, while the die 2 has a small-diametrical bearing diameter d2 pressing a material steel pipe 7 in a sandwiching manner against the respective bearing diameters d3 and d4 of the plug 4 formed on the side close to the proximal end of the plug 4 and a large-diametrical bearing diameter d1 pressing the material steel pipe 7 in a sandwiching manner against the large-diametrical bearing diameter d4 of the plug 4 on the side close to the distal end of the plug 4.

Therefore, inner and outer diameters of the drawn steel pipe 7*b* can be formed into a state shown in FIG. 6A determined by the bearing diameter d3 (small diameter) of the plug 4 and the bearing diameter d2 (small diameter) of the die 2, a state shown in FIG. 6B determined by the bearing diameter d4 (large diameter) of the plug 4 and the bearing diameter d2 (small diameter) of the die 2, and a state shown in FIG. 6C determined by the bearing diameter d4 (large diameter) of the plug 4 and the bearing diameter d1 (large diameter) of the die 2.

Next, steel pipe drawing work performed using the die 2 and the plug 4 using the above-described steel pipe drawing apparatus will be explained. FIGS. 6A, 6B and 6C are vertical sectional views showing steel pipe drawing states, and FIG. 6A shows a state of drawing a steel pipe while fixing the die supporting stand 30 at the left-side fixing position explained in FIG. 3 and performing fixation at the right-side fixing position explained in FIG. 5 regarding the support of the plug 4, showing a state of shaping the material steel pipe 7 while restricting the dimension thereof by the bearing diameter d2 (small diameter) of the die 2 and the bearing diameter d3 (small diameter) of the plug 4.

FIG. 6B shows a state of drawing a steel pipe while fixing the die supporting stand 30 at the left-side fixing position explained in FIG. 3 and performing fixation at the left-side fixing position explained in FIG. 5 regarding the support of the plug 4, showing a state of shaping the material steel pipe 7 while restricting the dimension thereof by the bearing diameter d2 (small diameter) of the die 2 and the bearing diameter d4 (large diameter) of the plug 4.

FIG. 6C shows a state of drawing a steel pipe while fixing the die supporting stand 30 at the right-side fixing position explained in FIG. 3 and performing fixation at the left-side fixing position explained in FIG. 5 regarding the support of the plug 4, showing a state of shaping the material steel pipe 7 while restricting the dimension thereof by the bearing diameter d1 (large diameter) of the die 2 and the bearing diameter d4 (large diameter) of the plug 4.

That is, the drawn steel pipe 7*b* shown in FIG. 7B is manufactured when the works in FIGS. 6A, 6B and 6C are continued in this order, the drawn steel pipe shown in FIG. 7A is manufactured when the works are continued in the order of FIGS. 6A, 6B, and 6A, and the drawn steel pipe shown in FIG. 7C is manufactured when the works are continued in the order of 6C, 6B, and 6C. Incidentally, moving the die supporting stand 30 or a supporting position of the plug 4 during drawing work is performed by the first hydraulic cylinder 20 driven by the first hydraulic unit 13 incorporated and the second hydraulic cylinder 20*a* driven by the second hydraulic unit 13*a* in consideration of a relationship between the drawing velocity of the steel pipe and the moving velocity of the die 2 or the plug 4.

By the way, when a stepped drawn steel pipe shown in FIG. 7 is manufactured by moving the die 2 and the plug 4 relatively in the same direction as the drawing direction and in the opposite direction thereto, there is a possibility that a wall-thickness gradient sags at a stepped portion in which a wall thickness changes in the steel pipe. In particular, in a case in which the hydraulic cylinder reciprocates once to manufacture a drawn steel pipe corresponding to one piece, if the moving velocity (v1) of the second hydraulic cylinder 20*a* at a time of the plug 4 changing from the small-diametrical bearing (d3) to the large-diametrical bearing (d4) in a forward stroke and the moving velocity (v2) of the second hydraulic cylinder 20*a* at a time of the plug 4 changing from the large-diametrical bearing (d4) to the small-diametrical bearing (d3) in a backward stroke are made to be the same velocity (v1=v2), a wall-thickness changing gradient of the drawn steel pipe in the backward stroke sags more in comparison to a wall-thickness changing gradient of the drawn steel pipe in the forward stroke.

Therefore, in a case in which a drawn steel pipe continuously produced by a steel pipe drawing apparatus is cut off piece by piece, when a central portion in a region in which a wall-thickness of the continuous drawn steel pipe is thick is a cutting position, a deviation occurs in a correspondence relationship between a cutting position in the forward stroke and a cutting position in the backward stroke, which results in that a cutting position cannot be positioned accurately. Therefore, conventionally, an ultrasonic wall-thickness meter is used to measure wall-thicknesses at respective portions in a drawn steel pipe so that the cutting position is positioned. In such a method, however, since wall-thicknesses at a number of potions must be measured by the ultrasonic wall-thickness meter, a lot of time is required for the work of measuring or determining the cutting position, which results in lowering of production efficiency of a drawn steel pipe.

In view of the above circumstances, in the present invention, as shown in FIG. 5, the position detecting sensor 20*b* attached between the second hydraulic cylinder 20*a* and the ram 21 in an additional manner detects a stroke position of the second hydraulic cylinder 20*a*, and feeds back the detected stroke position as a position detecting signal to the computer. Then, the computer converts the position detecting signal (namely, the detected stroke position) to a moving position of the plug (namely, a drawing position of a drawn steel pipe) connected to the distal end of the plug supporting rod 5. Further, the computer controls the moving velocity according to the stroke position of the second hydraulic cylinder 20*a* based upon the position detecting signal (the detected stroke position). In other words, the position detecting sensor 20*b* configures a control-system feedback loop, in which the position detecting sensor 20*b* detects a stroke position of the second hydraulic cylinder 20*a* as a moving position of the plug and feeds the position detecting signal back to the computer, and the computer controls the moving velocity according to the stroke position of the second hydraulic cylinder 20*a*.

At this time, since the drawing velocity of the drawn steel pipe and the moving velocity of the second hydraulic cylinder 20*a* are interchangeable, as a result, the drawing velocity of the drawn steel pipe is controlled according to the position of the second hydraulic cylinder 20*a*. Incidentally, the position detecting sensor 20*b* can be easily realized by, for example, an encoder.

Figure 8:
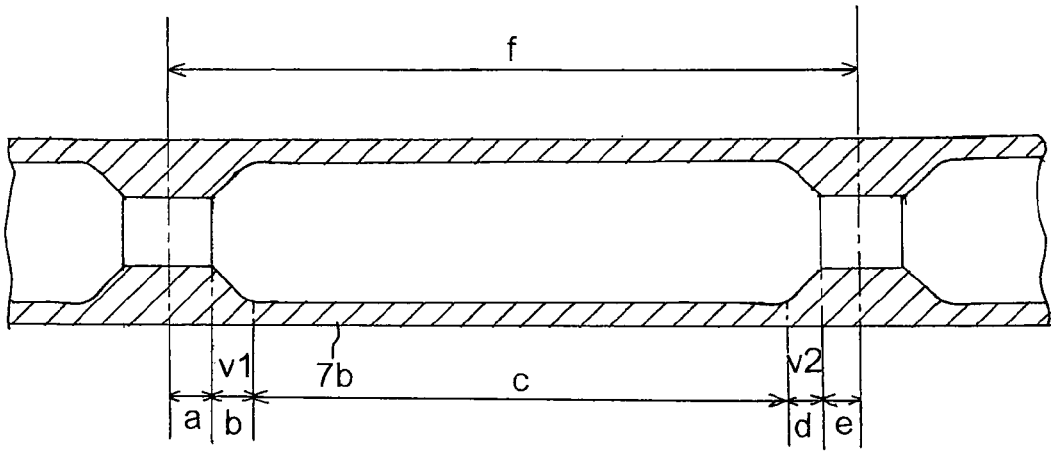
FIG. 8 is a vertical sectional view of a drawn steel pipe for one piece manufactured by feedback control using a position detecting sensor in the steel pipe drawing apparatus of the present invention.

FIG. 8 is a vertical sectional view of a drawn steel pipe corresponding to one piece manufactured according to feedback control using the position detecting sensor in the steel pipe drawing apparatus of the present invention. As shown in the cross-sectional view of the plug supporting stand in FIG. 5, when the position detecting sensor 20*b* provided on the second hydraulic cylinder 20*a* detects a stroke position of the second hydraulic cylinder 20*a* and feeds the stroke position back to the computer (not shown), the computer controls the moving velocity of the second hydraulic cylinder 20*a* according to the stroke position of the second hydraulic cylinder 20*a*. Thereby, as shown in FIG. 8, dimensional accuracy of respective wall-thicknesses portions in a drawn steel pipe is dramatically improved.

Explained in further detail with reference to FIG. 8, in "a" region in which the wall-thickness of the drawn steel pipe is thick (namely, a region in which the small-diametrical bearing (d3) of the plug 4 is used), since the position detecting sensor 20*b* detects a stroke position "a" to which the second hydraulic cylinder 20*a* corresponds and feeds the stroke position "a" back to the computer, the second hydraulic cylinder 20*a* is driven at a predetermined moving velocity by velocity control performed by the computer. Thereby, the drawn steel pipe is drawn at a predetermined moving velocity, so that the "a" region of the drawn steel pipe has a constant wall-thickness.

Next, in "b" region having a wall-thickness gradient in a direction in which the wall-thickness of the drawn steel pipe becomes thinner (namely, a region in which the plug 4 changes from the small-diametrical bearing (d3) to the large-diametrical bearing (d4)), since the position detecting sensor 20*b* detects a stroke position "b" to which the second hydraulic cylinder 20*a* corresponds and feeds the stroke position "b" back to the computer, the second hydraulic cylinder 20*a* is driven at a moving velocity v1 by velocity control performed by the computer. Thereby, the plug 4 changes at the moving velocity v1 from the small-diametrical bearing (d3) to the large-diametrical bearing (d4) (namely, the drawn steel pipe is drawn at the moving velocity v1) so that the wall-thickness becomes thinner in the "b" region of the drawn steel pipe according to a predetermined wall-thickness gradient in which no sag occurs.

Next, in "c" region in which the wall-thickness of the drawn steel pipe is thin (namely, a region in which the plug 4 uses the large-diametrical bearing (d4)), since the position detecting sensor 20*b* detects a stroke position "c" to which the second hydraulic cylinder 20*a* corresponds and feeds the stroke position "c" back to the computer, the second hydraulic cylinder 20*a* is driven at a predetermined moving velocity by velocity control performed by the computer. Thereby, the drawn steel pipe is drawn at a predetermined moving velocity, so that the "c" region of the drawn steel pipe has a constant wall-thickness.

Next, in "d" region having a wall-thickness gradient in a direction in which the wall-thickness of the drawn steel pipe becomes thicker (namely, a region in which the plug 4 changes from the large-diametrical bearing (d4) to the small-diametrical bearing (d3)), since the position detecting sensor 20*b* detects a stroke position "d" to which the second hydraulic cylinder 20*a* corresponds and feeds the stroke position "d" back to the computer, the second hydraulic cylinder 20*a* is driven at a moving velocity v2 by velocity control performed by the computer. At this time, if the moving velocity v1 in the abovementioned "b" region and the moving velocity v2 in this "d" region are equalized to each other, sags occur generated in the wall-thickness gradient in the "d" region of the drawn steel pipe. Therefore, the computer performs velocity control to make the moving velocity v2 of the second hydraulic cylinder 20*a* higher than the moving velocity v1 thereof in the "b" region (namely, v2>v1) based upon the position detecting signal in the "d" region.

Thereby, in the "d" region, since the second hydraulic cylinder 20*a* moves at the moving velocity v2 higher than the moving velocity v1 (namely, since the plug 4 changes from the large-diametrical bearing (d4) to the small-diametrical bearing (d3) at the higher moving velocity v2), the drawn steel pipe is drawn at the higher moving velocity v2, so that the possibility that sags would occur in the wall-thickness gradient in the "d" region of the drawn steel pipe is eliminated.

Next, in "e" region in which the wall-thickness of the drawn steel pipe is thick (namely, a region in which the plug 4 uses the small-diametrical bearing (d3)), since the position detecting sensor 20*b* detects a stroke position "e" to which the second hydraulic cylinder 20*a* corresponds and feeds the stroke position "e" back to the computer, the second hydraulic cylinder 20*a* is driven at a predetermined moving velocity by velocity control performed by the computer. Thereby, the drawn steel pipe is drawn at a predetermined moving velocity, so that the "e" region of the drawn steel pipe has a constant wall-thickness.

After a drawn steel pipe which is a continuous long object is manufactured by repeating the drawing steps by such computerized velocity control corresponding to the stroke position as described above; central positions in regions in which wall-thicknesses of the drawn steel pipe are thick are marked as cutting positions for respective pieces, and the drawn steel pipe is cut piece by piece with a length of a dimension "f".

In this manner, since the drawing control is performed at the moving velocity corresponding to the stroke position of the second hydraulic cylinder 20*a* by computerized control, the moving velocity v2 in the backward stroke position "d" of the second hydraulic cylinder 20*a* can be made higher at a desired level than the moving velocity v1 in the forward stroke position "a" thereof. As a result, the wall-thickness changing gradient in the forward stroke position "a" and the wall-thickness changing gradient in the backward stroke position "d" can be equalized. Thereby, the cutting positions of the drawn steel pipe manufactured continuously can be positioned with high accuracy. Incidentally, the whole length of the continuous drawn steel pipe is about 10 meters due to restriction in dimension of a steel pipe drawing apparatus or the like.

Though a drawn steel pipe with two wall-thicknesses formed in a stepping manner has been explained here, it is obvious that the present invention is not limited thereto and is applicable to a drawn steel pipe with wall-thicknesses formed in a multi-stepping manner. Further, the above embodiment has been explained as a specific example of the present invention, but it goes without saying that the present invention can be variously modified without departing from the spirit of the present invention and such modifications are within the scope of the present invention.

INDUSTRIAL APPLICABILITY

Since the steel pipe drawing apparatus of the present invention can manufacture a drawn steel pipe which is a long object or a short object with high accuracy and at low cost, it can be effectively utilized in an automobile industry or a construction machine industry.

What is claimed is:

1. A steel pipe drawing apparatus for manufacturing a stepped drawn steel pipe by moving a die and a plug relatively in the same direction as a steel pipe drawing direction and in an opposite direction thereto, comprising:

a die;

a first hydraulic cylinder, coupled to said die, which moves said die relatively in a direction corresponding to the steel pipe drawing direction;

a plug;

a second hydraulic cylinder, coupled to said plug, which moves said plug relatively in an opposite direction to a moving direction of said die;

a position detecting sensor which detects a stroke position of said second hydraulic cylinder;

a hydraulic unit coupled to said second hydraulic cylinder; and a computer coupled to said hydraulic unit which receives positional information detected by said position detecting sensor and controls a moving velocity of said second hydraulic cylinder based upon the positional information.

2. The steel pipe drawing apparatus according to claim 1, further comprising:

computer control means for controlling the moving velocity of said second hydraulic cylinder to equalize to each other an inclination angle of a wall-thickness gradient of the drawn steel pipe at a time of moving a bearing of said plug from a small diameter to a large diameter in a forward stroke and an inclination angle of a wall-thickness gradient of the drawn steel pipe at a time of moving the bearing of said plug from the large diameter to the small diameter in a backward stroke.

3. The steel pipe drawing apparatus according to claim 2, wherein:

said computer control means performs velocity control to make a second moving velocity v2 of said second hydraulic cylinder at the time of moving the bearing of the plug from the large diameter to the small diameter higher than a first moving velocity v1 of said second hydraulic cylinder at the time of moving the bearing of the plug from the small diameter to the large diameter.

4. A drawn steel pipe manufacturing method for manufacturing a stepped drawn steel pipe by moving a die and a plug relatively in the same direction as a steel pipe drawing direction and in an opposite direction thereto, comprising:

a first step, at which the die is moved relatively in a direction corresponding to the steel pipe drawing direction by a first hydraulic cylinder while the plug is moved relatively in a direction opposite to a moving direction of the die by a second hydraulic cylinder;

a second step, at which a position detecting sensor detects a stroke position of the second hydraulic cylinder; and a third step, at which a computer receives positional information detected by the position detecting sensor and controls a moving velocity of the second hydraulic cylinder based upon the positional information.

5. The drawn steel pipe manufacturing method according to claim 4, further comprising steps of:

producing one piece of the drawn steel pipe in one reciprocating stroke of the second hydraulic cylinder at said first step; and controlling the moving velocity of the second hydraulic cylinder at said third step to equalize to each other an inclination angle of a wall-thickness gradient of the drawn steel pipe at a time of moving a bearing of the plug from a small diameter to a large diameter in a forward stroke and an inclination angle of a wall-thickness gradient of the drawn steel pipe at a time of moving the bearing of the plug from the large diameter to the small diameter in a backward stroke.

6. The drawn steel pipe manufacturing method according to claim 5, further comprising a step of:

causing a second moving velocity v2 of the second hydraulic cylinder at the time of moving the bearing of the plug from the large diameter to the small diameter to be higher than a first moving velocity v1 of the second hydraulic cylinder at the time of moving the bearing of the plug from the small diameter to the large diameter.

* * * * *